United States Patent [19]

Rath

[11] 4,327,756

[45] May 4, 1982

[54] CLEANING MACHINE

[75] Inventor: Robert E. Rath, Morristown, N.J.

[73] Assignee: Metalwash Machinery Corp., Elizabeth, N.J.

[21] Appl. No.: 151,006

[22] Filed: May 19, 1980

[51] Int. Cl.[3] ..... B08B 3/02

[52] U.S. Cl. ..... 134/72; 134/104; 134/152

[58] Field of Search ..... 134/72, 104, 127, 131, 134/152, 198, 199, 68

[56] References Cited

U.S. PATENT DOCUMENTS

| | | | |
|---|---|---|---|
| 1,055,843 | 3/1913 | Warren | 134/131 X |
| 1,561,503 | 11/1925 | Barry et al. | 134/131 X |
| 1,793,246 | 2/1931 | Philips | 134/104 X |
| 1,944,679 | 1/1934 | Anstiss | 134/127 |
| 1,987,231 | 1/1935 | Engel | 134/127 |
| 2,250;238 | 7/1941 | Smith | 134/72 |
| 2,371,747 | 3/1945 | Faris et al. | 198/833 |
| 2,660,513 | 11/1953 | Ball | 134/131 X |
| 3,291,143 | 12/1966 | Huddle | 134/68 |
| 4,092,991 | 6/1978 | Rohrs | 134/127 |

*Primary Examiner*—Robert L. Bleutge
*Attorney, Agent, or Firm*—Nolte and Nolte

[57] ABSTRACT

A can cleaning machine having a lower conveyor belt and an extended coacting upper hold down belt is provided with a blow off unit at each successive stage of the cleaning operation. By extending the hold down belt and providing multiple blow off stations, the corrosive effects of the washing compositions are minimized and the hold down belt life is lengthened; and the washing compositions are maintained in their proper respective zones. This also prevents contamination of the rinse zones by carry over of the washing chemicals from the wash zones.

12 Claims, 4 Drawing Figures

CLEANING MACHINE

BACKGROUND OF THE INVENTION

1. Field of the Invention

The present invention concerns apparatus for cleaning or otherwise treating a plurality of articles as for example beverage cans or the like, or other more or less fragile bodies in a continuous and uninterrupted operation.

2. Description of the Prior Art

Apparatus suitable for such purposes has been disclosed in the patent to Marvin K. Rohrs, U.S. Pat. No. 4,092,991 granted June 6, 1978. As there seen, such apparatus may comprise a lower perforated conveyor in the form of an endless belt for transporting the articles that are to be cleaned or otherwise treated through the washing machine. An overhanging so-called "hold down" conveyor in the form of a wire mesh belt is also provided for controlling the position of the cans or other articles during the high pressure spray cycles: that is, to maintain the cans in the proper position so that the high pressure sprays will do their job efficiently and economically. Additionally, such "hold down" conveyor is to prevent damage to the cans that might result from tipping or tilting the same as they travel uninterruptedly through the apparatus assembly.

In the Rohrs patent, above mentioned, it is said that the machine basically comprises the lower article supporting conveyor and the overhead hold down conveyor: the remainder of the machine being largely conventional and comprising the usual sprays of chemicals and cleaning materials for cleaning, rinsing or otherwise treating the cans or other articles being washed or treated.

In the prior art, and in the Rohrs patent as well, the length of the hold down conveyor is much shorter than that of the lower can transporting carrier or conveyor. In fact, generally a separate independent hold down belt overlies the pre-rinse, spray bar, prewash and wash tanks individually, at or near the beginning of the continuous cycle which normally may subject the articles travelling therethrough to the steps of pre-rinse, prewash, wash, first rinse, treatment, second rinse, and diionized water rinse, with intermediate zones or sections for draining and blowing off to remove excess treating liquids.

With the arrangement just described, wherein the hold down conveyor overlies only a relatively short portion of the entire reach or length of the multi-stage continuous apparatus, certain problems in the industry have resulted. That is to say a rapid deterioration of the hold down belt is being experienced in the wash section of the washer due to the continuous exposure of this hold down belt to the action of the erosive and corrosive wash solution. The hold down belt does not get rinsed as does the main belt, that is the article transporting or carrier belt, and it is continuously subject to the wash chemistry. As a result it has been found necessary to replace the hold down belt much more often than is the case with the longer transporting belt or carrier.

Moreover, the current trend is to lower temperature cleaners and the use of higher pressures in the wash section. Lower temperature cleaners become very active and erosive and corrosive if higher than the recommended temperatures are used. On the other hand, if the cleaners are used at the higher end of the recommended temperature scale, they are naturally enough more effective and along with the higher pressure they provide a better cleaning job.

In addition, the use of high pressure rinsing is now recognized for its advantages in providing cans with improved final cleanliness. This means cans clean of all residues from washing and treatment chemistry. The use of high pressure rinsing in turn demands the control of the can while it is subject to these intense spray conditions. Under these conditions the use of a hold down in these areas provides the control necessary when using these higher pressures.

SUMMARY OF THE INVENTION

By extending the so-called hold down belt throughout the entire machine or at least a major portion thereof, instead of confining it to one or two portions of the apparatus, the rinsing and blow off effects of other zones within the washing apparatus tend to neutralize the corrosive chemistry of the wash and/or treating stages, thereby preserving or lengthening the useful life of the hold down belt.

In addition to extending the hold down belt through all or the major portion of the apparatus it is also preferred to provide the so-called blow off for the hold down belt and the cans at the end of each stage of the operation or at least the major stages thereof. By this means the removal of excess solution from the hold down belt is also assisted.

Further, in each treatment or rinse zone a last riser (spray bar) may be introduced both on the top and bottom which provides the make-up solution, which is the purest (it being introduced from cleaner solution locations such as fresh water, or cleaner rinse water locations), in this way providing the cleanest possible final rinsing of the cans and the hold down prior to their proceeding to the blow-off and the next zone.

The basic economic considerations involved in thus modifying the conventional washing machinery are as follows. That is to say, by extending the hold down throughout all or the major portion of the machine an opportunity is provided to flush the hold down belt in other zones of the apparatus thereby extending its life and removing it from the continuous exposure to the chemicals in the wash solution. By this means advantage can be taken of the high pressure and highly active chemistry of current washing compositions in working the chemistry at the higher temperature ranges where it becomes extremely active. Thus the combined benefits of currently prevailing high pressure and active chemistry provide an opportunity for reducing the overall exposure time of the hold down belt to the washing action. For the same reason, the relative lengths of each zone can be reduced. This would apply not only to the washing zones, but also to the other zones such as rinsing and treatment zones so that an overall shortening of the length of the can washing machines can be achieved with attendant cost reduction and price reduction.

BRIEF DESCRIPTION OF THE DRAWINGS

With the above and other objects in view, as will be apparent, the invention consists in the construction, combination and arrangement of parts, all as hereinafter more fully described, claimed and illustrated in the accompanying drawings wherein:

DESCRIPTION OF THE PREFERRED EMBODIMENTS

Figure 1:
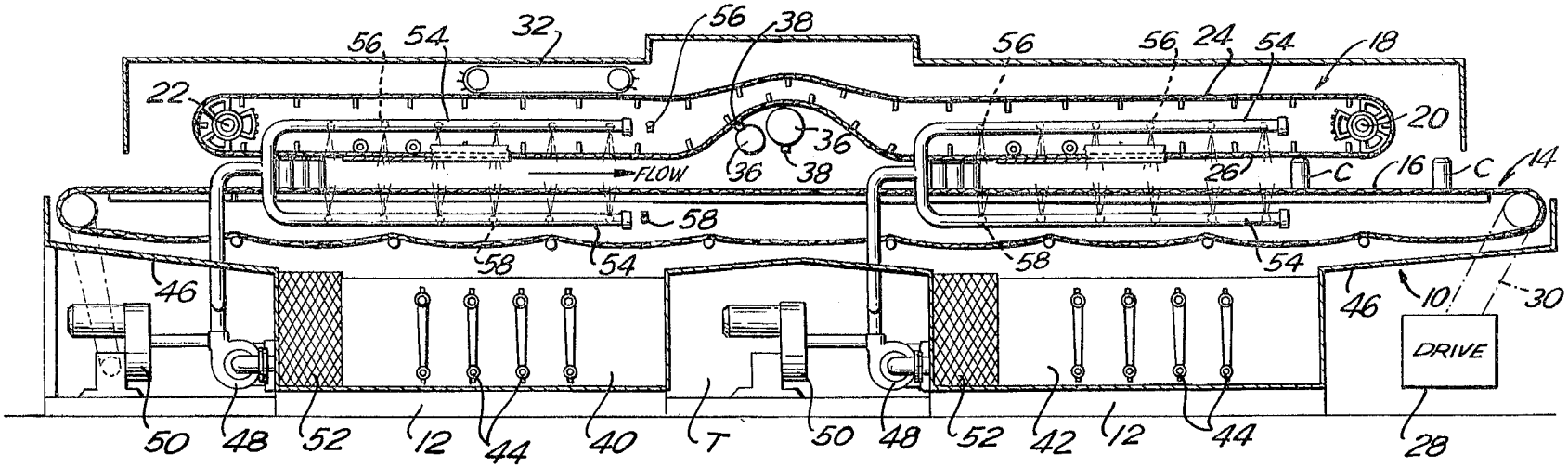
FIG. 1 is a side view of a preferred form of a cleaning machine according to the present invention including the extended hold down and co-acting hold down can blow off, and a last riser or spray bar rinse as the articles being cleaned proceed from one fluid application zone to the next, with some parts of the machine omitted for purposes of clarity (as referrred to more particularly hereinafter)
Figure 2:
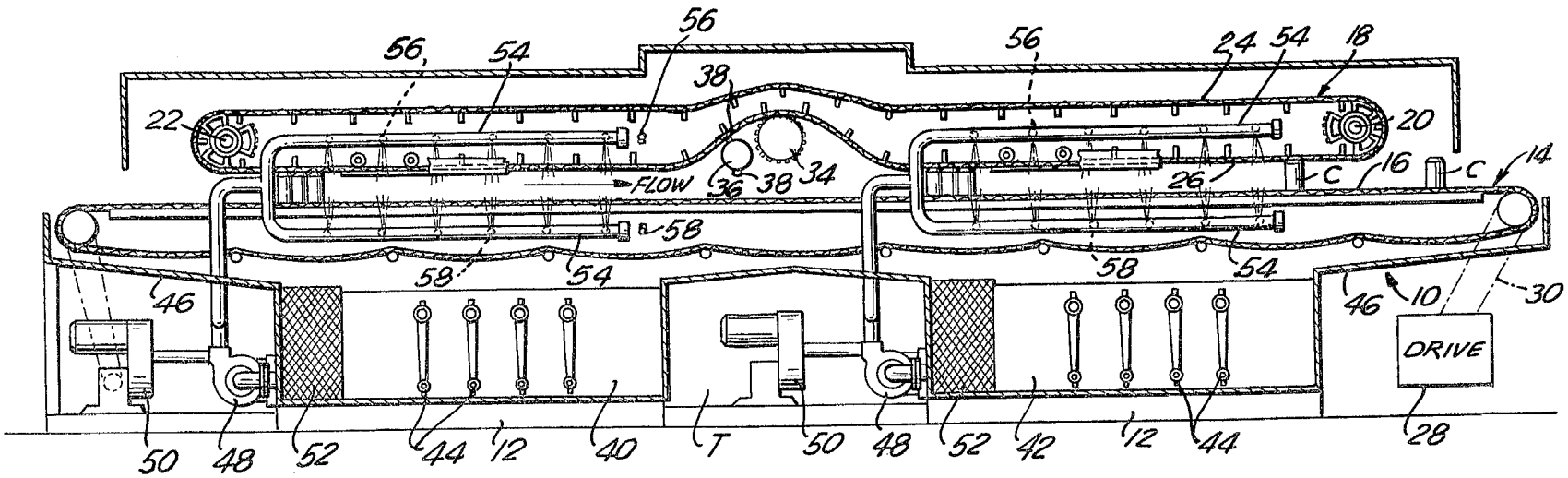
FIG. 2 is a side view of another embodiment of the invention, comprising a sprocket arrangement to guide the hold down up and over a dual blow off for both the hold down belt and the cans being carried by the can carrier-conveyor on the upper surface of which the cans travel.
Figure 3:
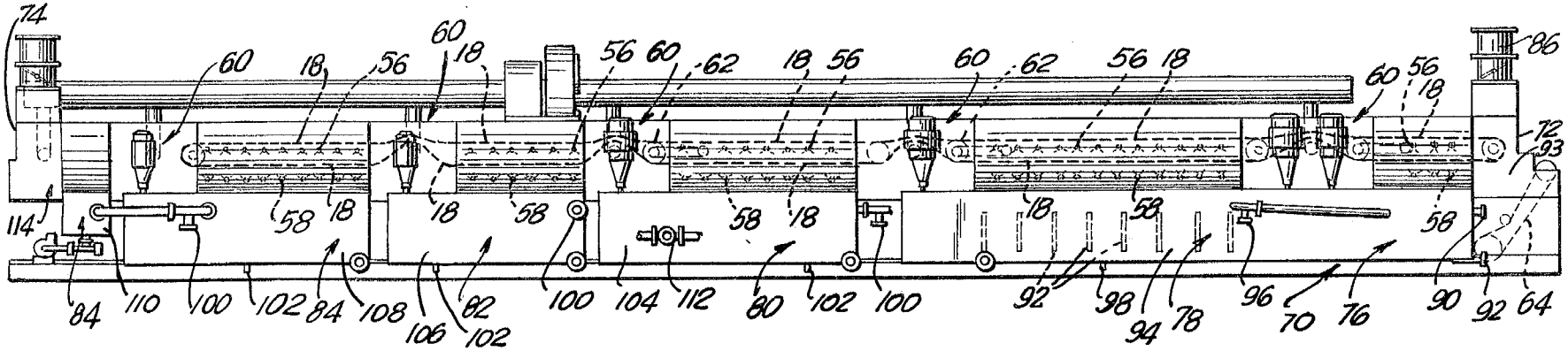
FIG. 3 is a side elevation of a substantially complete machine cleaning assembly embodying one form of the invention and comprising a whole series of coordinated zones arranged successively one after the other in tandem and including a plurality of wash, drain and blow off, rinse and treatment stages.
Figure 4:
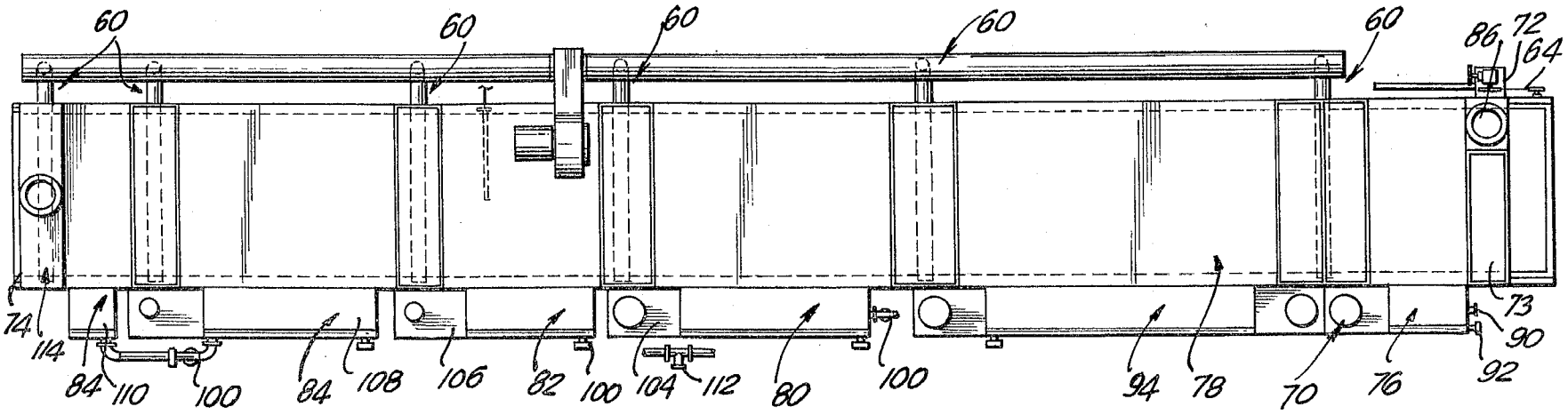
FIG. 4 is a plan view of the cleaning machine range of FIG. 3.

Referring to the drawings, FIGS. 1 and 2 illustrate the basic structural modifications of the invention including the extended hold down and co-acting hold down can blow off, and only a three-stage cycle of pre-wash, drain/blow off, and hot wash is there shown. The additional stages in the continuous cycle as for example, rinsing and hot treatment, are omitted from FIGS. 1 and 2 in order to focus attention upon the extended hold down and co-acting blow off for the hold down. However, the extra stages of the cleaning cycle are illustrated in FIGS. 3 and 4.

In FIG. 1, then, the machine frame is indicated generally at 10. It may be mounted on longitudinally extended beams 12. The machine, basically, comprises a lower can or other article carrier 14 preferably a reticulate belt having an upper run or reach 16 upon which the cans or articles "C" may be transported through the various cycles of the range constituted in the machine 10. Above the carrier 14 lies the hold down conveyor 18 which comprises a drive shaft 20 by which drive may be applied to the shaft 20 by conventional drive means. The machine frame 10 may also be slotted so that the height of the drive shaft 20 may be adjusted relatively to the carrier conveyor 14 and fixed in suitable position: having regard to the height of the cans travelling through the gap that is defined by the upper reach 16 of the carrier 14 and the overhanging underside of the hold down belt 18.

The other end of the hold down conveyor 18 is provided with an idler shaft 22 which is also conventionally mounted in vertical slots on the frame 10 so as to be vertically adjustable for variable height.

The hold down belt 18 may be formed of a wire mesh or similar perforate and flexible construction defining an upper reach 24 and a lower course 26, the lower course 26 being constructed and arranged to prevent tipping or tilting of the cans "C" as they travel through the machine cleaning cycle.

Both the hold down belt 18 and the carrier belt 14 may be driven from a common drive unit 28 through conventional belt systems indicated generally at 30. As seen in FIG. 1, to supplement the drive system 28, 30 a caterpillar "come along" belt drive 32 may, if desired, be mounted to co-act with the upper reach 24 of the hold down belt 18: thus augmenting the principal hold down and carrier drive 28, 30. Alternatively and as noted in FIG. 2 of the drawings, a driven or idling sprocket member 34 may be substituted for the come along auxiliary belt drive 32 of FIG. 1 to supplement the main drive system 28, 30. Furthermore, both the come along belt 32 and the sprocket 34 may be used simultaneously if desired.

In the case of any of these three alternatives, that is whether the come along drive 32 or the sprocket 34, or both are employed to augment the principal drive 28, 30, a so-called pneumatic "blow off" unit or compressed air jet cylinder 36 with an air outlet nozzle 38 is positioned to blow off the hold down belt 18 in order to reduce carry-over of solution adhering to the belt from one section of the apparatus to the next, and to contain such solution within the proper area or processing zone. This pool of carry-over or excess solution is removed as the cans "C" pass the pneumatic blow offs 36 each of which may comprise a transversely extending duct communicating with an appropriately directed nozzle 38 from which a continuous ribbon of air emanates to blow the solution from the hold down belt as well as from the bottoms of the can bodies. The excess solution or liquid is permitted to fall to a conveniently disposed receptacle or collection trough indicated generally at "T" to be re-used if desired.

In the arrangement of FIG. 1 there are two separate and distinct blow offs 36: one for the hold down 18 and the other for cans "C" which pass thereunder. On the other hand, in FIG. 2 only a single combined or dual function blow off 36 for both the cans "C" and the hold down belt 18 is provided.

Extending beneath the carrier belt 14 in tandem are first a pre-wash tank 40 and following that a wash tank 42, each of the tanks 40 and 42 comprising a wash fluid reservoir provided with heating coils 44 therein. In the embodiment of the invention exemplified in FIGS. 1 and 2 the tanks 40, 42 may also comprise pan sections 46 to catch wash fluid cascading from the transporting belt 14 and lead it to the reservoir in each of the two tanks. In FIGS. 3 and 4 the catch pan sections 46 are omitted.

Each of the two tanks 40 and 42 has a pump 48 driven by a conventional driving unit 50. And each of the pumps 48 also has an intake communicating with a screened section 52 of its respective reservoir, and an outlet to furnish wash fluid under pressure to a pair of branched upper and lower pipes 54 that are disposed to one side of and which extend longitudinally along the hold down and carrier belts 18, 14. The upper branch 54 has a series of offset side pipes 56 extending transversely of both conveyors 14, 18 and between the upper and lower courses of the hold down conveyor 18. The pipes 56 have at intervals along their lengths conventional jet orifices which are directed downwardly so as to pass wash fluid pumped by the pump 48 through the lower course of the hold down 18 and to impinge on the cans "C."

To like effect, the lower branch 54 has a series of offset side pipes 58 which extend transversely between the upper and lower courses of the carrier 14. These pipes 58 are provided likewise with upwardly directed jet orifices to direct wash fluid or liquid reaching those orifices from the pump 48 through the upper course of the carrier belt 14 onto the cans "C."

As will be understood the purpose and function of the blow off stations seen in FIGS. 1 and 2 of the drawings is to reduce the time of contact of the hold down belt 18 with any corrosive or erosive chemicals in the wash fluids, and to prevent or impede the passage of such chemicals from one stage or zone of the washing cycle to another. To that end the chemical containing wash fluids that are displaced by the blow off from the hold down conveyor 18 are allowed to fall into the intermediate catch basin "T" located between the two tanks. Thus the life of the hold down belt 18 is extended by removing it from continuous exposure to the wash solution chemicals.

FIGS. 3 and 4 illustrate a preferred embodiment of the invention as applied to a long range continuous can cleaning machine cycle wherein the cans to be cleaned travel successively through separate but interconnected zones which are here denominated for convenience as entrance pre-rinse, pre-wash, wash, first rinse, treatment, second rinse, last rinse and discharge.

As will be evident from FIG. 3, the hold down conveyor 18 of that embodiment of the invention extends longitudinally through substantially all of the cleaning machine apparatus and through all of the washing and rinsing zones referred to above except the last rinse and discharge zones.

At spaced intervals along the length of the hold down 18 a drain and blow off zone 60 is provided to reduce carry-over of the chemical containing wash fluids adhering to the belt. A sprocket drive 62 or other conventional tracking arrangement is seen in the central or medial drain and blow off zones separating each wash and rinse stage. The drive arrangement may be omitted from the two other drain and blow off zones that is those zones nearest the entrance and exit ends respectively of the whole cleaning machine range. It is to be understood, of course, that depending upon the extent to which the main or principal drive 64 for both of the belts 14, 18 needs to be augmented, the booster drive sprockets 62 may also be interposed in one or more of the remaining drain/blow off sections. Similarly, either or both of the interiorly mounted sprocket drives 62 may be replaced in the other stages of the cleaning cycle. In any event it is preferred to have at least one sprocket drive 62 at one of the drain and blow off zones to supplement the main drive 64 for the two conveyors 14, 18.

In the schematic side elevation and plan view of the embodiment FIGS. 3 and 4 a typical can cleaning range of apparatus embodying the particulars of the present invention is illustrated. Such apparatus may comprise an automatic machine for continuously cleaning and processing or treating articles such as cans or other similarly shaped bodies, including an outer frame or housing generally designated as 70 and having an entrance or vestibule 72 and an exit 74.

Separating the exit from the entrance are a series of tandem in line zones 73, 76, 78, 80, 82 and 84 devoted respectively and successively to pre-rinsing, pre-washing, washing, initial rinsing, treating, and a two-stage final rinsing of the cans passed through the machine from entrance 72 to exit 74. At spaced intervals between these zones thus described a drain and blow off station 60 is provided for the purpose of removing excess cleaning fluid from the hold down belt 18 as it proceeds through the apparatus range from one zone to the next.

More particularly, the range comprises a steam inlet 86 adjacent the entrance 72 for heating the fluid contents of a pre-wash tank 88 underlying the pre-wash zone 76 and first drain/blow off section 60, and an overflow control 90 and drain 92 for controlling the liquid fill and level of the pre-wash tank.

Next to the pre-wash tank 88 is the wash tank 94 which may be provided with a plurality of heating coils 92, an overflow control 96 and drain 98. Similar overflow and drain controls 100, 102 may be provided in the first rinse 104, treatment 106, second rinse 108 and final rinse 110 tanks which follow in that order the wash tank 94.

A source of water supply for all of the tanks, which may be municipal water, is schematically indicated at 112.

A combination drain/blow off station 60 overlies the end portion of each of the tanks and constitutes means for removing at least a substantial portion of any excess chemical containing fluids from the hold down belt 18 as it travels through that station.

In operation the cans "C" are deposited on the moving endless conveyor belt 14 and are held thereon against tipping or tilting as by means of the hold down flat wire belt 18: both of the belts 14 and 18 being driven primarily from the common drive 64, with the drive of the hold down belt 18 being augmented or supplemented as necessary by means of one or more of the auxiliary driven sprockets 62. As the cans "C" pass successively over each one of the fluid filled tanks, they are individually sprayed from above and below by means of the spaced spray pipes 56, 58.

As stated above, in each treatment and rinse zone, according to the present invention, a last riser or set of top and bottom bars 56 and 58 is provided, in advance of each blow off station, to provide the purest make-up solution (it being introduced from cleaner solution locations such as fresh water, or cleaner rinse water locations). By such means the cleanest possible final rinsing of the cans "C" and the hold down belt 18 in each individual treatment and rinse zone is assured before the cans "C" and belt 18 proceed to the next blow off station 60 and fluid application zone.

As the cans "C" progress from the pre-rinse and pre-wash zone 73 and 76 into the wash stage 78, they pass through an intermediate drain and blow off area 60 wherein the hold down belt 18 is subjected to the blow off action so as to free it from the wash fluid chemicals that may be adherent to the hold down 18 emerging from the pre-wash tank 88. This drain and blow off action upon the hold down belt 18 is repeated as the cans progressively are passed through the pre-rinse, pre-wash, wash, first rinse and treatment zones 73, 78, 80, 82, and into the second or final rinse zone 84. As will be noted, such drain/blow off stage 60 separates each of the pre-rinse, pre-wash, wash, rinse and treatment zones 73, 76, 78, 80 and 82: so that at regularly spaced intervals the hold down belt 18, which extends longitudinally through substantially the entire machine range, is periodically freed or cleansed of whatever wash fluid chemicals it may acquire en route through the tandemly disposed pre-wash, wash, rinse, treating and final rinsing zones of the can cleaning range.

If desired, a conveniently constructed dryer 114 may be added to the apparatus range after the last rinsing of the cans "C."

What is claimed is:

1. Apparatus for continuously cleaning cans or the like comprising in combination a plurality of aligned chemical-containing fluid cleaning zones for cleaning said cans, a transport conveyor having an upper course upon which the cans to be cleaned are carried continuously through said cleaning zones, an elongate overhead hold down conveyor extending longitudinally through substantially all of said cleaning zones and constructed and arranged to co-act with said transport conveyor to prevent said cans from tilting or tipping during passage of the cans through said cleaning zones, and blow off means adjacent said hold down conveyor for retarding deterioration of said hold down conveyor resulting from contact with said chemical-containing fluid.

2. Apparatus according to claim 1 wherein the means for retarding deterioration of the hold down conveyor comprises at least one blow off station interposed between said cleaning zones to remove at least a portion of said chemical-containing fluid from the hold down conveyor as it travels successively through said cleaning zones.

3. The apparatus of claim 1 further characterized in that the means for retarding deterioration of the hold down conveyor comprises a blow off station through which said hold down conveyor moves following its passage through each of said cleaning zones.

4. The apparatus of claim 3 further characterized in that each of said blow off stations is provided with a drive member for maintaining substantially uniform the rate of travel of the cans through the apparatus.

5. The apparatus of claim 3 further characterized in that said blow off station comprises means for simultaneously removing excess can cleaning fluid from said hold down belt and from said cans.

6. The apparatus of claim 3 further characterized in that means for applying cleaning fluid under pressure to said holddown conveyor and the cans are interposed adjacent and in advance of each blow-off station to provide a final rinsing of said cans and hold-down before reaching each blow-off and the next following cleaning zone.

7. The apparatus of claim 1 wherein said means for retarding deterioration of the hold down conveyor comprises a blow off member for removing corrosive and erosive chemical-containing fluid from the hold down conveyor at the end of at least one cleaning stage.

8. The apparatus of claim 7 further characterized in that said blow off member is constructed and arranged to remove corrosive and erosive chemical-containing fluid from the hold down conveyor at the end of all of said cleaning stages.

9. The apparatus of claim 1 wherein said cleaning zones comprise a tandem arrangement for pre-washing, washing, initially rinsing, treating, finally rinsing, and drying said cans.

10. The apparatus of claim 1 wherein said cleaning zones comprise a tandem arrangement for pre-rinsing, pre-washing, initially rinsing, treating, finally rinsing and drying said cans.

11. Apparatus for cleaning cans or the like according to claim 1 further characterized in that said blow off means comprises means for applying air under pressure to such cans and independent means for applying air under pressure to the hold down conveyor.

12. Apparatus according to claim 1 further characterized in that said blow off means comprises unitary means for simultaneously applying air under pressure to said cans and said hold down conveyor.

* * * * *